United States Patent [19]

Johnson

[11] 4,170,549

[45] Oct. 9, 1979

[54] VIBRATING SCREEN APPARATUS

[76] Inventor: Louis W. Johnson, 345 Palomino Dr., Eugene, Oreg. 97401

[21] Appl. No.: 830,624

[22] Filed: Sep. 6, 1977

Related U.S. Application Data

[63] Continuation of Ser. No. 638,535, Dec. 8, 1975, abandoned.

[51] Int. Cl.[2] ..... B07B 1/42

[52] U.S. Cl. ..... 209/363; 209/367; 74/61

[58] Field of Search ..... 209/367, 366.5, 366, 209/326, 325, 329, 332, 363, 364; 74/61, 117, 60, 600, 114, 117; 404/133

[56] References Cited

U.S. PATENT DOCUMENTS

| | | | |
|---|---|---|---|
| 1,385,768 | 7/1921 | Angle | 74/600 |
| 1,943,076 | 1/1934 | Jackson | 404/114 X |
| 2,238,711 | 4/1941 | Soldan | 209/326 |
| 2,592,237 | 4/1952 | Bradley | 74/571 R |
| 2,994,431 | 8/1961 | Becker | 209/367 |
| 3,287,983 | 11/1966 | Austin | 209/367 X |
| 3,442,381 | 5/1969 | Johnson | 209/326 |
| 3,625,074 | 12/1971 | Waschulewski | 209/332 X |
| 3,704,631 | 12/1972 | Marks | 209/367 X |
| 3,722,302 | 3/1973 | Piatkowski | 209/367 X |
| 3,879,281 | 4/1975 | Davies | 209/366.5 X |
| 4,078,996 | 3/1978 | Cohen-Allurs | 209/366.5 X |

FOREIGN PATENT DOCUMENTS

| | | | |
|---|---|---|---|
| 1473491 | 2/1967 | France | 404/133 |
| 819621 | 9/1959 | United Kingdom | 404/114 |

*Primary Examiner*—Robert Halper

*Attorney, Agent, or Firm*—Haven E. Simmons; James C. Nemmers

[57] ABSTRACT

A vibrating screen apparatus of the type wherein bearing housing discs and associated gears are mounted on self-aligning bearings which are supported by fixed internal spindles, with the gears centered on the bearings, and hubs connect the bearing housing discs to shafts extending through the spindles. The screen apparatus has a plurality of unbalanced shaft assemblies to impart vibratory movement to screens and are adjusted as to the angle of stroke of vibration by adjusting, relative to one shaft assembly, gearing associated with that shaft assembly. In one embodiment, a cam crank turns a bearing housing disc relative to an outer gear mounted thereon and a second cam crank limits such turning. In a second embodiment, a pinion is maually turned to turn a driving gear relative to a bearing housing disc. In a third embodiment, a pair of eccentric shafts are journaled in pairs of self-aligning bearings and are drivingly interconnected by a pair of gears keyed to the shafts, one of the gears being adjustably keyed to its shaft to adjust the angle of stroke.

13 Claims, 10 Drawing Figures

VIBRATING SCREEN APPARATUS

This is a continuation, of application Ser. No. 638,535, filed Dec. 8, 1975 now abandoned.

BACKGROUND OF THE INVENTION

In a horizontal vibrating screen using either a straight line reciprocating action or my exclusive oval action, disclosed and claimed in U.S. Pat. No. 3,442,381, it is very valuable to be able to vary the stroke angle relative to the horizontal. A steep angle, say 60°, will retain the materal being screened for a longer time on the screening surface and thereby increase the screening accuracy, but at the cost of reduced capacity moving over the screen. A flatter angle of say 30° will move the material rapidly, but with less screening accuracy. Most screens, other than that disclosed in my above-mentioned patent, operate on a fixed-at-factory stroke angle or can only be changed with much difficulty. One gear must be removed from its shaft, the number of teeth counted and divided into 360° to get the number of degrees per tooth, then replaced with the desired degree change. Gears must be tight on their shafts or troubles will occur. It is readily understood that this is a difficult, cumbersome and time consuming task. It is seldom that anyone will bother doing so once the machine is in service. Moreover, the vibrating mechanism must be at or very near the centroid (center of gravity) of the screen box to maintain uniform action should timing be varied.

Because of the unique design of my three shafted screen disclosed in my above-mentioned U.S. Pat. No. 3,442,381, it has been found to be possible to mount the planes of gears directly over centers of self-aligning bearings. This is a very important and valuable feature because gear centers will not change should a timing shaft fail or become loose in its hub.

SUMMARY OF THE INVENTION

An object of the invention is to provide an improved vibrating screen apparatus wherein a pluality of oppositely rotated eccentric shaft assemblies are driven by phase adjustable gearing.

Another object of the invention is to provide phase adjustable gearing.

A further object of the invention is to provide easily adjusted gear drives for plural shafted vibrating screens.

Another object of the invention is to provide plural shafted vibrating screens having driving members mounted by self-aligning bearings through which shafts extend.

Another object of the invention is to provide in vibrating screens improved shaft assemblies having stationary spindles supporting inner races of self-aligning bearings which have outer races carrying gear means.

Another object of the invention is to provide an improved three shafted vibrating screen having three shaft assemblies driven by ring-like gears, wherein each shaft assembly has a gear hub carrying impulse weights, the gear hub associated with the center shaft assembly being releasably keyed to its associated ring-like gear, with means for turning the gear hub relative to the gear to change the stroke angle of the apparatus.

Another object of the invention is to provide an improved shaft assembly carrying a ring gear releasably keyed to eccentrically weighted inner disc means, and a cam crank for turning the gear relative to the disc means.

Another object of the invention is to provide an improved shaft assembly carrying a ring gear releasably keyed to eccentrically weighted inner disc means, and a rotatable pinion carried by the disc means for engaging inner teeth of the gear to rotate the gear relative to the disc means.

Figure 1:
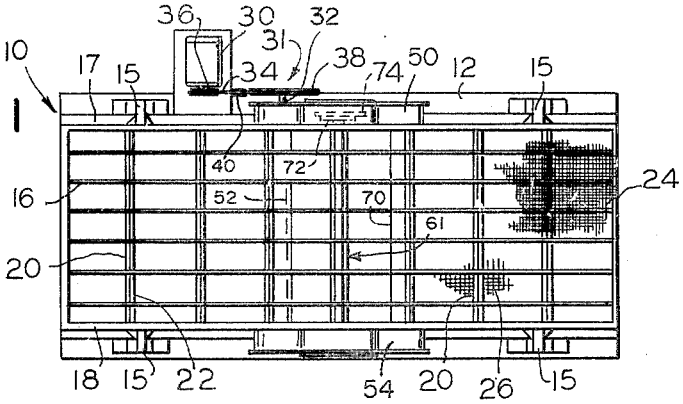
FIG. 1 is a top plan view of a vibrating screen apparatus forming one embodiment of the invention.
Figure 2:
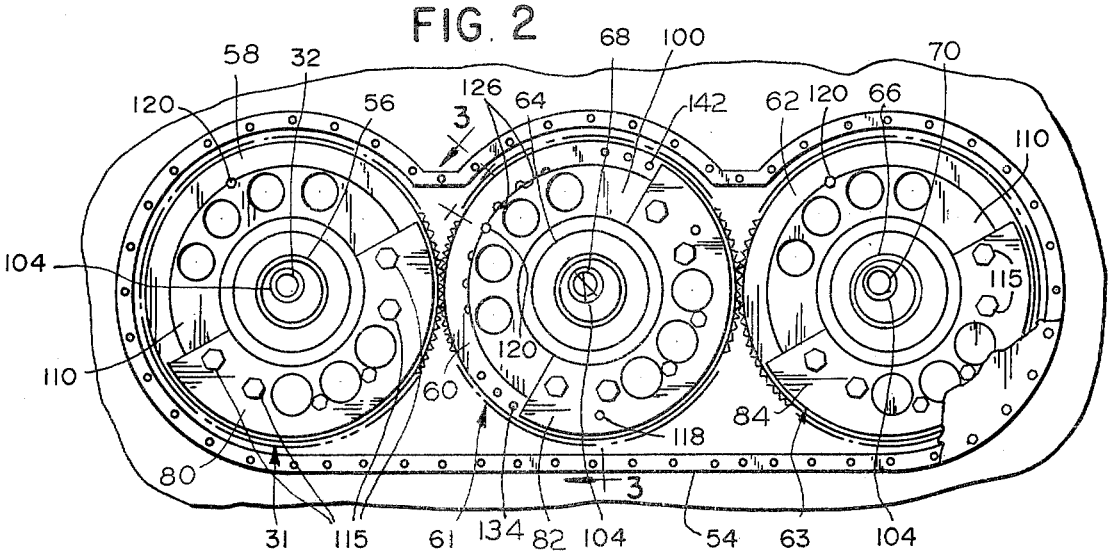
FIG. 2 is a fragmentary side elevation view of the vibrating screen apparatus of FIG. 1 on an enlarged scale with portions thereof broken away.
Figure 4:
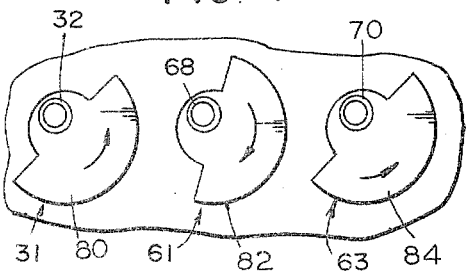
FIG. 4 is a diagrammatic side elevation view showing the relationship of the weights.

Referring now in detail to the drawings, there is shown in FIGS. 1 to 4 a vibrating screen apparatus forming one embodiment of the invention and including a screening unit 10 supported for vibratory movement on a base 12 by four spring assemblies 15. The screening unit includes a frame 16 having side plates 17 and 18 connected by upper and lower horizontal decks 20 and 22 supporting upper and lower screens 24 and 26.

The screening unit 10 is vibrated by a gear driven, phase adjustable, multiple, eccentric weight mechanism including an electric motor 30 mounted on the base 12 and driving a shaft assembly 31 including a drive shaft 32 (FIGS. 1 and 2) through a belt 34 (FIG. 1) and sheaves 36 and 38. A spring biased idler sheave 40 (FIG. 1) presses against the belt to accommodate the vibrating movement of the screening unit while maintaining driving contact between the belt and the sheave 38.

The drive shaft 32 extends through a case 50 (FIG. 1) on the side plate 17, and through the side plate 17, a crosstube 52 bolted to the side plates 17 and 18 and extends into a case 54 mounted on the side plate 18. The drive shaft 32 has a hub 56 (FIG. 2) bolted to a gear hub 110 carrying a gear 58. The gear 58 meshes with and drives a gear 60 of a shaft assembly 61, and the gear 60 meshes with and drives a gear 62 of a shaft assembly 63. Any of the three shaft assemblies could be used as the drive assembly should installation conditions require that the machine be assembled to so accommodate.

The gears 58, 60 and 62 are identical except for certain modifications to gear 60 to be explained. Gear 60 is carried by gear hub 100, while gear 62 is carried by a gear hub which is numbered 110, because it is identical to the gear hub 110 for gear 58. Gear hub 100 carries a hub 64 for a shaft 68 of the shaft assembly 61. There is a hub 66 for a shaft 70 of the shaft assembly 63. The shafts 68 and 70 are like shaft 32, except that shafts 68 and 70 terminate within the case 50 and thus are driven shafts. Each shaft is of lightweight construction and has a hollow central section (See FIG. 3) and is eccentric to its hubs.

Each of the shaft assemblies 31, 61 and 63 has a weight assembly at each end. The weight assemblies are of identical construction except for certain modifications in the two assemblies for shaft assembly 61, which will be described hereinafter. Each weight assembly includes a pair of impulse weights, the weights for case 54 being shown in FIG. 2 and numbered 80, 82 and 84 for shaft assemblies 31, 61 and 63, respectively. The weights are mounted in a manner to be presently discussed. The weights are identical, except as described hereinafter.

Each shaft assembly has its own weights in phase with one another. The gears 58, 60 and 62 are so meshed that the pairs of impulse weights 80 and 84 are always in phase with each other, but the impulse weights 82 are out of phase with the weights 80 and 84, as is evident from FIGS. 2 and 4. Thus, the gears constrain the shaft assemblies 31 and 63 to rotate in the same direction and opposite to that of the shaft assembly 61. The movement of the weights 82 in a direction opposite to that of weights 80 and 84 means that the weights 81 will be 180° out of phase with weights 80 and 84 twice each revolution, and in phase twice each revolution. However, since the weights 80 and 84 are out of phase with weights 82 at all times except that just mentioned, the term "out of phase" is believed appropriate to describe the phase relationship of such weights.

The hubs 56, 64 and 66 are similar in construction, so only the details for one hub, hub 64 (FIG. 3) will be explained. Hub 64 is of hollow cupped construction and is mounted on its gear hub 100 by bolts 109. The gear hub 100 is mounted by a self-aligning bearing 90 on a bearing spindle 92 secured by bolts 93 to the side plate 18 and crosstube 52. The inner race of the bearing is locked by a nut 99 on a tapered portion 101 of the spindle 92.

Figure 3:
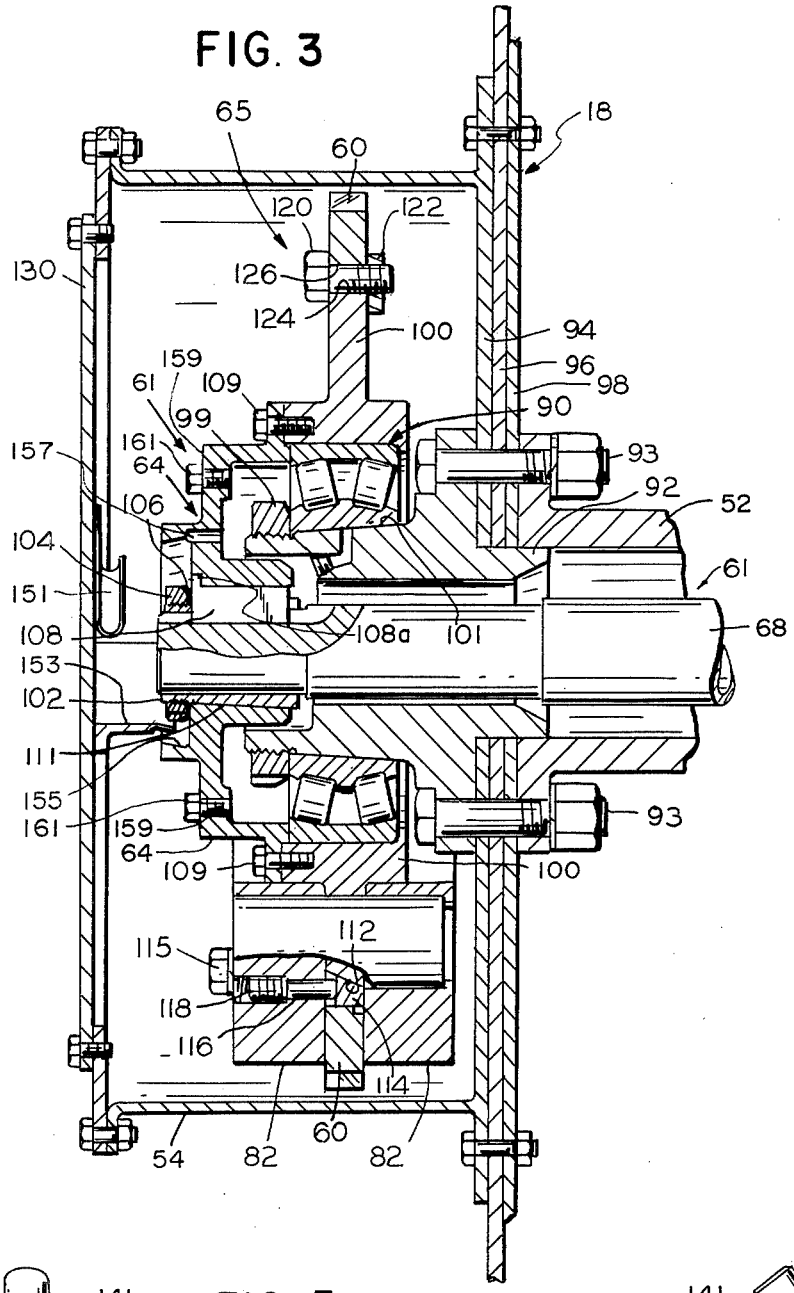
FIG. 3 is a sectional view taken along line 3—3 of FIG. 2 showing the weight assemblies.

The plates 17 and 18 are each made up of two thick plate members, labeled 96 and 98, for plate 18 in FIG. 3. The plates are unmachined and may, therefore, tend to cock the bearing spindle 92 somewhat off from parallel relative to the longitudinal axis of the associated shaft 68. However, if spindle 92 is cocked, the self-aligning bearing 90 allows the associated hub to remain aligned with shaft 68.

Hub 64 has a tapered bore 111 to receive a tapered sleeve 102. The hub 64 is keyed to the shaft 68 by a drive key 108 having a cleat 108*a* fitting in a notch in the hub 64. The cleat 108*a* and a nut 104 hold the key against endwise movement.

The hub 64 is bolted by bolts 109 to the gear hub 100. The latter has two ramps 112 milled into it for wedging blocks 114. The ramps are approximately 90° apart and are disposed an even distance each side from a plane through a key bolt 120 and the center line of bearing 90.

Each of the weight assemblies for shaft assemblies 31 and 63 has a gear hub 110 which is like gear hub 100 of shaft assembly 61 except for the modification to gear hub 100 of shaft 68 that permits adjustment of its impulse weights 82 as described below.

The impulse weights 80, 82 and 84 (FIG. 2) are arcuate, and are secured by bolts 115 in laterally aligned pairs to the opposite sides of the associated gear hubs. The gear 60 (FIG. 3) fits closely but freely slidably between the outer portions of the associated pair of impulse weights 82 on the hub 64. Two dowel pins, not shown, accurately position the weights of each pair relative to each other so all other holes and parts are in exact alignment.

Pressure pins 116 are pushed by pressure screws 118 to press the wedging blocks 114 inwardly to clamp the gear 60 tightly to the associated gear hub 100, while the gears 58 and 62 (FIG. 2) are shrink fitted onto their associated gear hub 110.

A key bolt 120 (FIG. 3) passes through matching half bores 126, 124 in the gear 60 and the gear hub 100, respectively, and threads into a nut 122 which is welded to gear hub 100 so that it cannot become dislodged. The half bore in gear 60 is one of a series of half bores 126 (FIG. 2) to permit relative circumferential adjustment of the gear 60 and gear hub 100 upon removal of the key bolt 120.

The gears 58 and 62 have similar key bolts 120 but they key their gears 58, 62 and gear hubs 110 in fixed unadjustable relationship.

To adjust the angle of stroke, the gear hub 100 with its attached weights 82 is rotated relative to gear 60 to achieve the desired out-of-phase relationship of the weights 82 relative to the weights 80 and 84 and then keyed and locked into position. The specifics of such adjustment will be explained for the weights 82 shown in FIGS. 2, 3 and 4.

Figure 5:
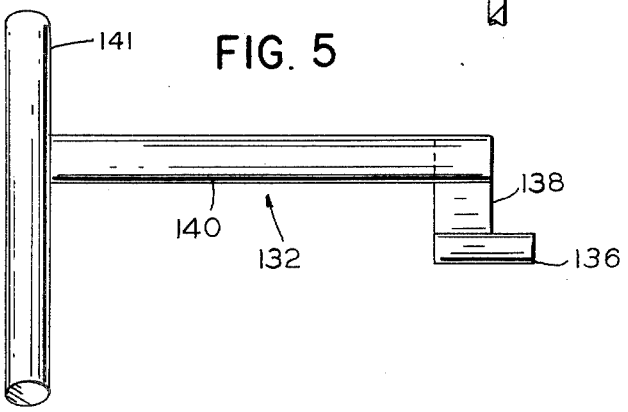
FIG. 5 is a side elevation view of a manual crank for adjusting the phase of the vibrating screen apparatus of FIG. 1.
Figure 6:
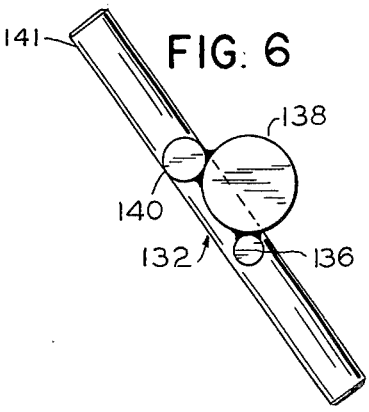
FIG. 6 is an end view of the crank of FIG. 5.
Figure 7:
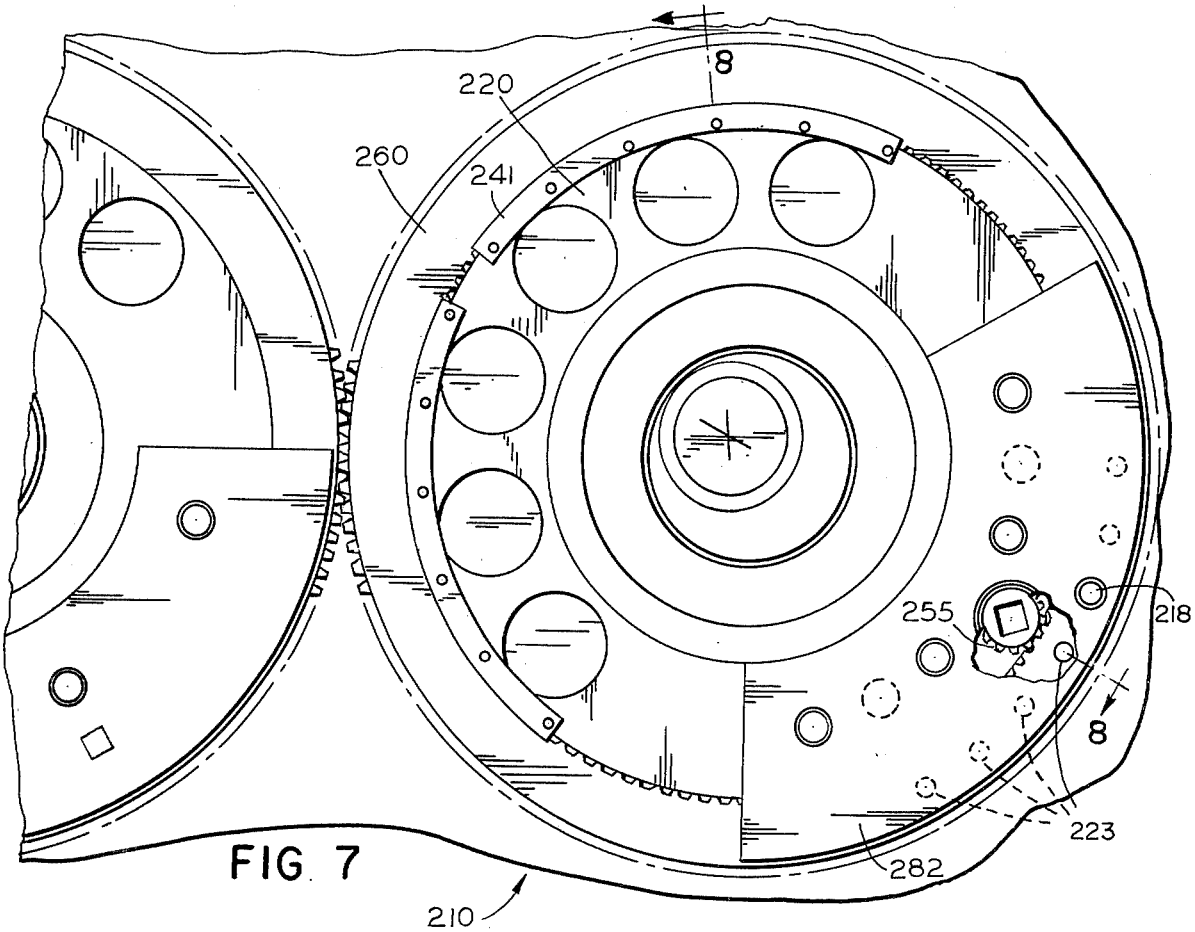
FIG. 7 is a side elevation view with portions broken away of a vibrating screen apparatus forming an alternate embodiment of the invention.
Figure 8:
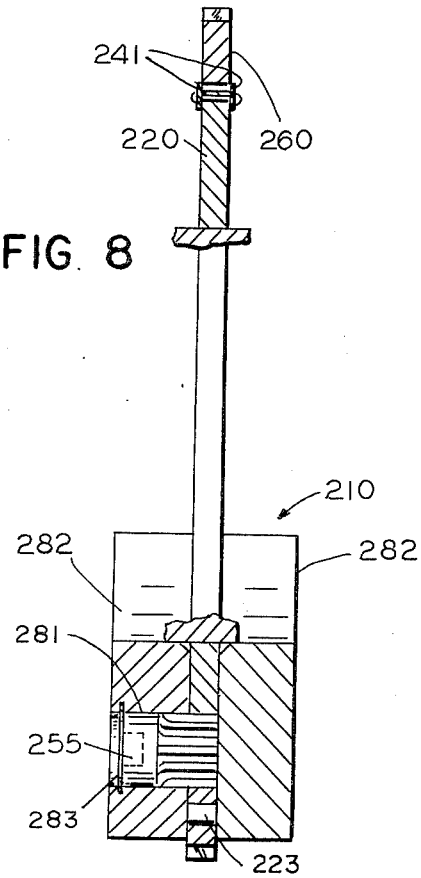
FIG. 8 is a fragmentary sectional view taken along line 8—8 of FIG. 7.
Figure 10:
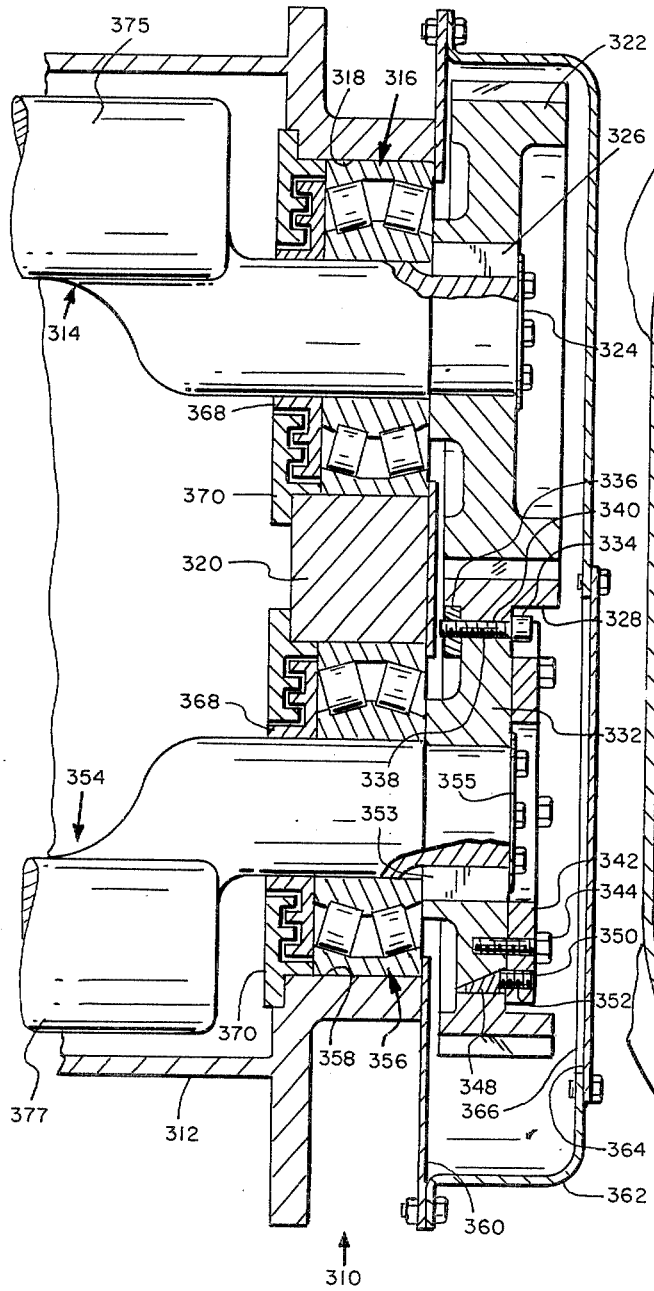
FIG. 10 is a vertical sectional view taken along line 10—10 of FIG. 9.
Figure 9:
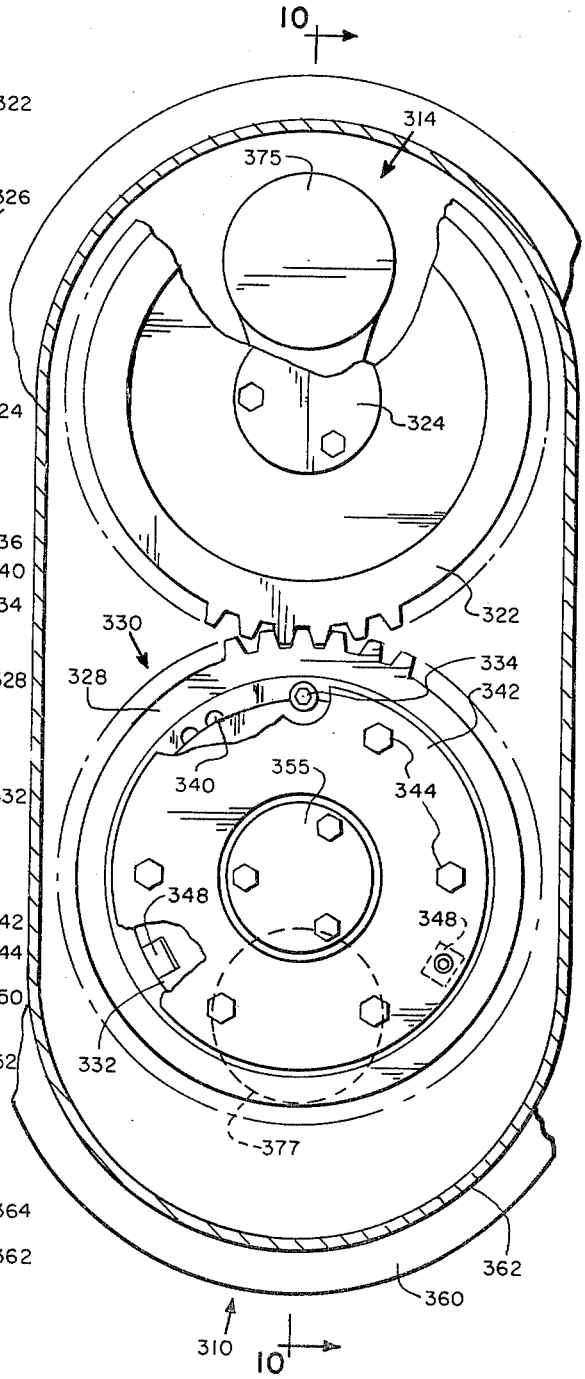
FIG. 9 is a side elevation view with portions broken away of a vibrating screen apparatus forming an alternate embodiment of the invention.

A cam crank 132 (FIG. 5) is used in the adjustment operation and is to fit in one of a series of holes 134 or in one of a series of holes 142 formed in the gear 60. The crank includes a pivot pin 136, a larger cylindrical camming portion 138, a shaft portion 140 and a handle 141.

Assume that the stroke angle is to be more toward the horizontal. First, the cover plate 130 (FIG. 3) is removed to expose one end of associated shaft assembly 61. Next, the key bolts 120 for the gear hub 100 is removed and the pivot pin 136 of the cam crank 132 (FIG. 5) is inserted into the hole 134 next to the weight to prevent the weight from dropping upon release of wedging blocks 114. The wedging blocks 114 are then released by backing off screws 118. Thereafter, the cam crank is turned to rotate the gear hub 100 and the associated weights 82 counterclockwise until the associated key bolt 120 (FIGS. 2 and 3) can be inserted in the next-in-line half bore 126 that matches the half bore 124 in the gear hub 100. The step is repeated if going beyond the first matching bore position is desired. This will give a flatter stroke angle relative to the horizontal.

If it is desired to rotate gear hub 100 and its associated weights 82 for a more upright stroke, it is necessary or at least advisable to use two of the cam cranks, the lower one to restrain sudden dropping of the weights 82, and the upper one to overcome any friction that may be present. The upper cam crank is inserted into the bore 142 (FIG. 2) closest the weights 82, while the lower cam crank is inserted in the hole 134 nearest the weights 82. Then the upper and lower cam cranks are turned so that the upper crank forces the weights 82 clockwise (against any frictional resistance that might be present) while the lower cam crank is turned to permit such movement.

To provide lubrication, the lower portion of the case 54 (FIG. 3) is supplied with lubricant and the rotating weights 80, 82 and 84 and the gears 58, 60 and 62 sling the oil throughout the case 54. Some of the oil thus slung is caught by a trough 151 and drops into a spout 153 as is evident from FIG. 3. A similar arrangement is provided for each end of each shaft assembly 31, 61 and 63. From the spout 153 the oil drops into an undercut recess 155 in the respective hubs 56, 64 and 66. The centrifugal force created by the rotating hub forces the oil through a passage 157 into the hollow hub to lubricate the bearing 90. Tapped 157 into the hollow hub to lubricate the bearing 90. Tapped puller bores 159 are provided, and are closed by threaded screws 161 securely held by lockwashers, or other locking structure.

EMBODIMENTS OF FIGS. 7 AND 8

A vibrating screen apparatus 210 forming an alternate embodiment of the invention is like that of FIGS. 1–6 except that the apparatus 210 has a center position gear 260 that is internally as well as externally toothed and the internal teeth mesh with a pinion 255, which may be turned by an extension wrench (not shown). The pinion is journaled in a bore 281 in one of two impulse weights 282 like the weights 82 (FIG. 3). A snap ring 283 holds the pinion in the bore 281. Pairs of arcuate plates 241, secured to a bearing housing disc 220, guide the gear 260 and hold the gear centered on the disc 220.

To key the gear 260 to the disc 220, a bolt 218 is inserted through an untapped bore in the outer one of the weights 282 and through an aligned one of circumferentially spaced bores 223 in the gear 260 and is screwed into a tapped bore (not shown) in the inner one of the weights 282.

EMBODIMENT OF FIGS. 9 AND 10

A vibrating screen apparatus 310 forming an alternate embodiment of the invention is two-shafted rather than three as in the above-described embodiments and is variable to vary the angle of stroke of a free body such as a vibrating screen. The apparatus 310 includes a frame or housing 312 secured to the screen or other body to be vibrated. An eccentric shaft 314 is driven by a motor (not shown) like the motor 30 (FIG. 1). The shaft 314 is journaled in a pair of self-aligning bearings 316 mounted in bores 318 in flanged end 320 of the housing 312. A gear 322 is secured to one end of the shaft by a plate 324 bolted to the shaft, and a key 326 keys the shaft to the gear.

The gear 322 meshes with and drives a ring gear 328. The ring gear is releasably keyed to a hub 332 by a socket head bolt 334 and a nut 336. The bolt extends through a half bore 338 in the hub 332 and any desired one of a series of circumferentially spaced half bores 340 in the ring gear 328. A disc 342, secured by capscrews 344 to the hub 332, serves, with the nut 336 to hold the ring gear 328 and hub 332 against relative axial movement.

Wedges 348, pressed by setscrews 350 screwed into bores 352 in the disc 342, releasably take out play between the ring gear 328 and hub 332.

The hub 332 is keyed by a key 353 to an eccentric shaft 354. The shaft 354 is journaled in a pair of self-aligning bearings 356 fitting in bores 358 in the flanged end 320. A disc 355 is bolted to the end of the shaft 354 to hold the hub 332 against the inner races of the associated bearing.

A gear housing base plate 360 is secured to the flanged end 320, and a flanged cover 362 is secured to the base plate 360 and has a removable access door 364 covering an access opening 366.

The gear housing is filled with lubricant which is kept from escaping by a pair of ribbed sealing discs 368 secured to the shafts 314 and 354 and a second pair of ribbed sealing discs 370 which fit into the bores 318 and 358 and are flanged. The ribs of the sealing discs interleave and form labyrinth seals.

In the operation of the apparatus 310, the shaft 314 is rotated, and rotates the shaft 354 through the gears 322 and 328 at the same rate of speed. The direction of vibration is determined by the phase relationship of eccentric portions 375 and 377 of the shafts 314 and 354, which is 180° in the adjustment shown. To change this phase relationship, the door 364 is removed, the bolt 334 removed and the screws 350 backed off. Then, the hub 332 and the shaft 354 are rotated to position a different one of the half bores 340 in alignment with the half bore 338. The bolt 334 is replaced, the wedges 348 are retightened, and the cover 364 is replaced.

What is claimed is:

1. In a vibrating screen apparatus,
screening means,
a plurality of unbalanced shaft assemblies for vibrating said screening means,
a plurality of intermeshing gears drivingly interconnecting the shaft assemblies,
one of said gears being an annular gear,
gear hub means fitting in said one gear,
and releasable means releasably coupling said annular gear to said gear hub means for adjustment of the phase relationship of the shaft assemblies.

2. The vibrating screen apparatus of claim 1 wherein said releasable means includes a releasable keying member adapted to key the gear hub means to the annular gear at selected relative positions of adjustment of the gear hub means and the annular gear.

3. The vibrating screen apparatus of claim 2 including a fixed spindle, said one of the shaft assemblies including a self-aligning bearing on the spindle and a shaft extending through the spindle, the gear hub means being journaled on the spindle and being keyed to the shaft.

4. The vibrating screen apparatus of claim 2 wherein the releasable means includes releasable clamping means independent of said keying member for releasably holding the annular gear tightly on the gear hub means.

5. The vibrating screen apparatus of claim 2 wherein the gear has a plurality of inwardly facing keying notches spaced along the inner periphery thereof, the gear hub means having an outwardly facing notch, the keying member comprising a bolt adapted to be positioned in the notches.

6. The vibrating screen apparatus of claim 5 wherein the gear has a plurality of holes therein for journaling an adjusting crank, the gear hub means having a shoulder engageable by the crank.

7. The vibrating screen apparatus of claim 6 including a pair of inertia weights secured to the gear hub means, one of the weights forming the shoulder.

8. The vibrating screen apparatus of claim 2 wherein the gear has internal teeth, and including a pinion carried by the gear hub means and adapted to be turned to move the gear relative to the hub means.

9. The vibrating screen apparatus of claim 8 wherein the gear hub means includes a hub member and a pair of weights secured to the hub member and bracketing a portion of the gear, the pinion being journaled in one of the weights.

10. The vibrating screen apparatus of claim 1 wherein there are three shaft assemblies, said one of the shaft assemblies being positioned between theother shaft assemblies.

11. In a vibrating screen apparatus, screening means, a plurality of unbalanced shaft assemblies for vibrating said screening means, at least one of said shaft assemblies including a shaft and an unbalanced weight means for the shaft, a plurality of intermeshing gears drivingly interconnecting the shaft assemblies, one of said gears being associated with said shaft and weight means, means fixedly securing said weight means to said shaft, and means mounting said one gear for relative circumferential adjusting movement with respect to said weight means and with respect to said shaft without causing relative movement between said weight means and shaft to thereby enable adjustment of the phased relationship of the unbalanced shaft assemblies.

12. In a vibrating screen apparatus, screening means, three unbalanced shaft assemblies for vibrating said screening means, said three unbalanced shaft assemblies comprising a central assembly flanked by a pair of end assemblies, at least one assembly including a shaft and a weight means for the shaft, a gear for each assembly, with the gear for the central assembly meshing with the gears for the end assemblies, the gears for the end assemblies being fixedly secured in place, the weight means for the central assembly being immovably secured to the associated shaft, means mounting the gear for the central assembly for relative circumferential adjusting movement with respect to the associated weight means without disturbing the immovable relationship of said weight means and said shaft to enable adjustment of the phased relationship of the unbalanced shaft assemblies.

13. In a vibrating screen apparatus as recited in claim 12, wherein the mounting means is so constructed as to enable relative circumferential adjustment while the gears remain in meshing relationship.

* * * * *